US007594874B2

(12) United States Patent
Meissner

(10) Patent No.: US 7,594,874 B2
(45) Date of Patent: Sep. 29, 2009

(54) QUICK CONNECT CLIMBING HOLD

(76) Inventor: Richard K. Meissner, W288 N8433 N. Bay Rd., Hartland, WI (US) 53029

( * ) Notice: Subject to any disclaimer, the term of this patent is extended or adjusted under 35 U.S.C. 154(b) by 268 days.

(21) Appl. No.: 11/402,712

(22) Filed: Apr. 12, 2006

(65) Prior Publication Data

US 2007/0240281 A1 Oct. 18, 2007

(51) Int. Cl.
*A63B 9/00* (2006.01)

(52) U.S. Cl. ..... 482/36; 482/37

(58) Field of Classification Search ..... 482/35–37; 403/322.2; 411/348, 267, 270; 248/231.9, 248/231.91; 249/40, 42, 46; 269/309; 182/92
See application file for complete search history.

(56) References Cited

U.S. PATENT DOCUMENTS

| | | | | |
|---|---|---|---|---|
| 691,765 | A | 1/1902 | Hayes | |
| 1,602,708 | A | 10/1926 | Russell | |
| 2,250,580 | A | 7/1941 | Gregory | |
| 2,373,083 | A * | 4/1945 | Brewster | 411/348 |
| 2,402,925 | A | 6/1946 | Spooner | |
| 2,472,392 | A | 6/1949 | Alexander | |
| 2,515,807 | A | 7/1950 | Spooner | |
| 2,599,207 | A | 6/1952 | Spahr et al. | |
| 2,618,940 | A | 11/1952 | Wyzenbeek | |
| 3,046,827 | A | 7/1962 | Myers | |
| 3,101,641 | A | 8/1963 | Walker et al. | |
| 3,117,484 | A | 1/1964 | Myers | |
| 3,145,441 | A | 8/1964 | Strandrud | |
| 3,277,767 | A | 10/1966 | Allen et al. | |
| 3,390,712 | A | 7/1968 | McKay | |
| 3,392,767 | A | 7/1968 | Stillwagon, Jr. | |
| 3,482,809 | A | 12/1969 | McCall, Jr. | |
| 3,507,528 | A | 4/1970 | Desmarchais | |
| 3,596,554 | A | 8/1971 | Low | |
| 3,652,099 | A | 3/1972 | Bilz | |
| 3,921,334 | A | 11/1975 | Black, Sr. | |
| 4,184,692 | A | 1/1980 | Benson et al. | |
| 4,309,042 | A | 1/1982 | Fauth et al. | |

(Continued)

OTHER PUBLICATIONS www.grip101.com/products/1374.xml.

(Continued)

*Primary Examiner*—Loan H Thanh
*Assistant Examiner*—Allana Lewin
(74) *Attorney, Agent, or Firm*—Ryan Kromholz & Manion S.C.

(57) ABSTRACT

A selectively rotatable climbing hold removeably attached to the front face of a climbing wall with a quick connect fastener system. The climbing hold includes a first component and a second component. The first component or the second component includes a shaft, and the other one of the first component or the second component includes a bore, and the shaft is positioned within the bore to releasably secure the climbing hold to the climbing wall. The shaft may further include a portion having a polygon shape or a spline, the portion having the polygon shape or spline is configured to be positioned within a mating shape of the bore. The first component or the second component may also include a detent and the other one of the first component or the second component may include an indent, the detent being releasably receivable by the indent to releasably secure the climbing hold to the climbing wall.

16 Claims, 8 Drawing Sheets

U.S. PATENT DOCUMENTS

| | | | | | |
|---|---|---|---|---|---|
| 4,355,917 | A | | 10/1982 | Bunger | |
| 4,453,449 | A | * | 6/1984 | Hollmann | 89/1.806 |
| 4,483,639 | A | | 11/1984 | McCandless, II | |
| 4,577,875 | A | | 3/1986 | Miyakawa | |
| D284,164 | S | | 6/1986 | Tseng | |
| 4,645,149 | A | | 2/1987 | Lowe | |
| 4,692,073 | A | | 9/1987 | Martindell | |
| 5,061,112 | A | * | 10/1991 | Monford, Jr. | 403/328 |
| 5,092,587 | A | | 3/1992 | Ulner et al. | |
| 5,125,877 | A | | 6/1992 | Brewer | |
| 5,230,491 | A | | 7/1993 | Tseng | |
| 5,254,058 | A | | 10/1993 | Savigny | |
| 5,256,116 | A | | 10/1993 | Robinson | |
| 5,282,709 | A | * | 2/1994 | Chaput et al. | 411/433 |
| 5,350,265 | A | | 9/1994 | Kinner | |
| 5,394,594 | A | | 3/1995 | Duran | |
| 5,517,734 | A | | 5/1996 | Korpi | |
| 5,642,960 | A | * | 7/1997 | Salice | 403/328 |
| 5,732,954 | A | | 3/1998 | Strickler et al. | |
| 5,865,559 | A | | 2/1999 | Yang | |
| 5,944,634 | A | | 8/1999 | Neves | |
| D427,047 | S | | 6/2000 | Franklin | |
| 6,074,327 | A | * | 6/2000 | Franklin | 482/37 |
| 6,193,261 | B1 | | 2/2001 | Hahka | |
| D452,742 | S | | 1/2002 | Takahashi | |
| 6,386,789 | B1 | | 5/2002 | Chausse et al. | |
| 6,419,610 | B1 | | 7/2002 | Jonas et al. | |
| 6,551,215 | B1 | | 4/2003 | Gordon | |
| 6,709,365 | B2 | * | 3/2004 | Zeilinger | 482/35 |
| 6,752,562 | B2 | | 6/2004 | Mills et al. | |
| 6,786,669 | B2 | | 9/2004 | Tsui et al. | |
| 6,872,039 | B2 | | 3/2005 | Baus et al. | |
| 6,872,167 | B1 | | 3/2005 | Meissner | |
| 6,893,184 | B2 | | 5/2005 | Mills et al. | |
| 6,942,600 | B2 | | 9/2005 | Zeilinger | |
| 7,250,020 | B2 | * | 7/2007 | Barbafieri et al. | 482/35 |
| 2003/0100407 | A1 | | 5/2003 | Barbafieri et al. | |
| 2004/0162190 | A1 | | 8/2004 | Diamond et al. | |
| 2005/0081685 | A1 | * | 4/2005 | Ernesti | 81/60 |
| 2005/0109559 | A1 | | 5/2005 | Eike | |
| 2005/0245355 | A1 | * | 11/2005 | Brewer et al. | 482/37 |
| 2006/0258511 | A1 | * | 11/2006 | Postma | 482/35 |
| 2007/0164182 | A1 | * | 7/2007 | MacKay | 248/300 |

OTHER PUBLICATIONS www.voodooholds.com.
www.synrock.com.
www.nicros.com.
www.metoliusclimbing.com.
www.climbpyramide.com.
www.atomikclimbingholds.com.
www.stoneageclimbing.com.
www.cheapholds.com.
www.oddityholds.com.
www.ascensionholds.com.
www.crimppimp.com.
www.pmeclimb.co.uk/control.htm.
www.earthtreksclimbing.com/etch.
www.uncarvedblock.com.au/enter.html.
www.holdz.co.uk.
www.grholds.com/home.htm.

* cited by examiner

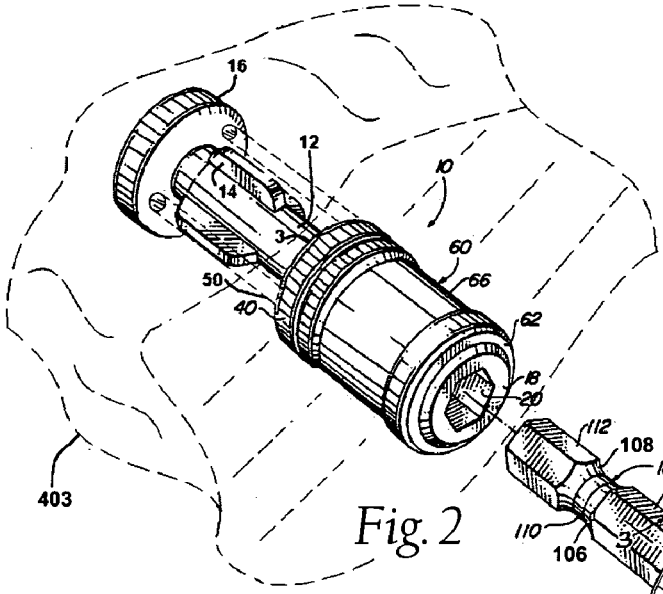
Fig. 2
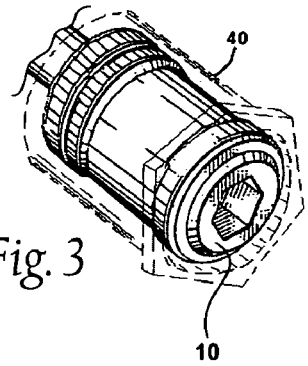
Fig. 3
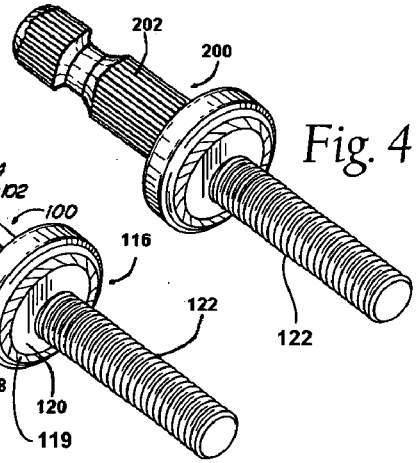
Fig. 4
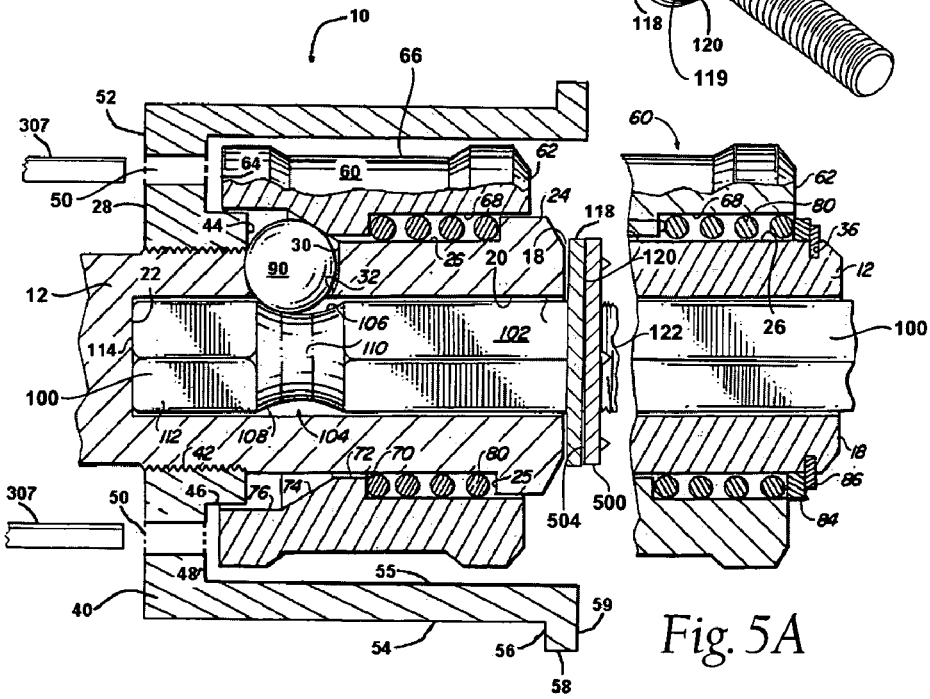
Fig. 5A
Fig. 5

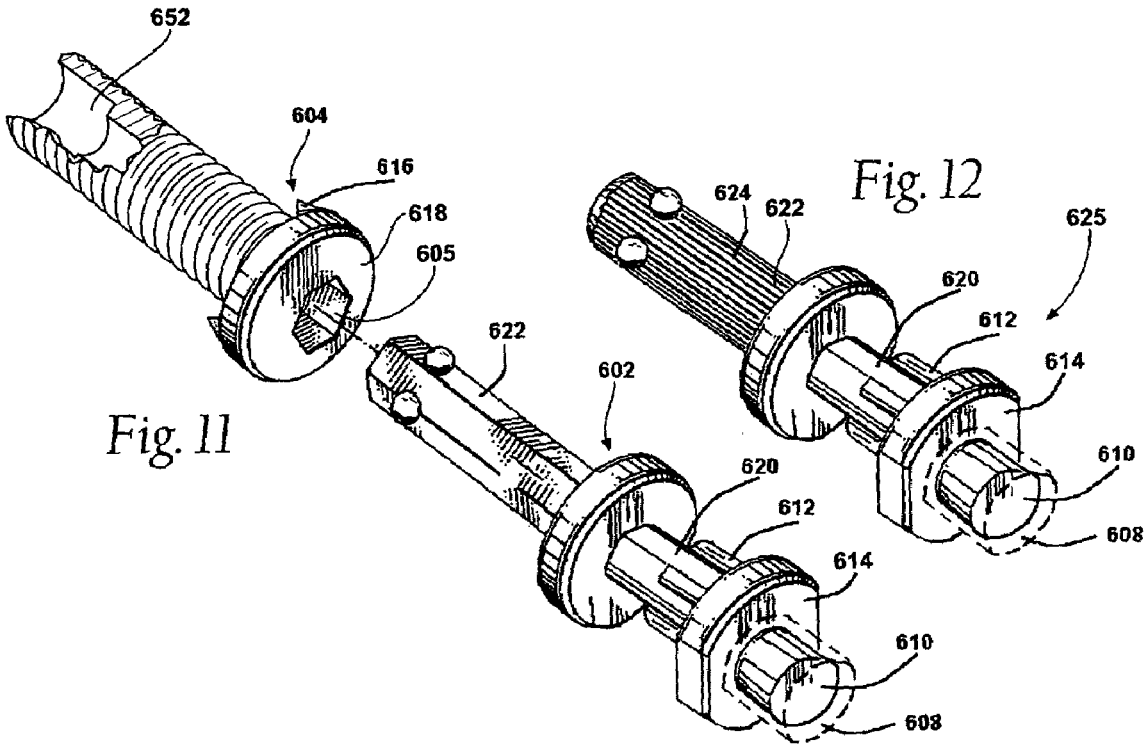
Fig. 11
Fig. 12
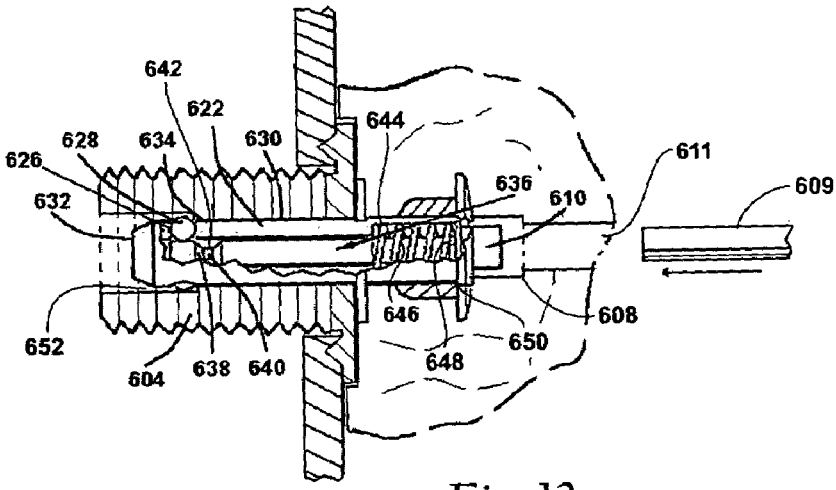
Fig. 13

QUICK CONNECT CLIMBING HOLD

FIELD OF THE INVENTION

The present invention relates generally to climbing walls and, more particularly, pertains to climbing holds and related mounting (fixing) systems.

BACKGROUND OF THE INVENTION

Rock climbing is an activity enjoyed by many people, however climbing natural rock faces of ten requires traveling considerable distances. Climbing wall facilities have thus become popular as they provide practice and training for climbers locally. These facilities typically provide a vertical climbing wall with a variety of climbing holds mounted, i.e., bolted, on the surface that simulate a natural rock face. Facilities may include, but are not limited to, elementary schools, high schools, business establishments specializing in rock climbing, and gymnasiums.

A continuing challenge for operators of climbing wall facilities is to provide new, more challenging and varied climbing routes by varying the location or rotation of the climbing holds. The holds also are of diverse forms or shapes to further vary the climb. Nuts and bolts must be screwed or unscrewed each time a climbing hold is installed, removed, rotated, moved, or changed on or from the climbing wall.

Systems to provide a diversity of climbs are known in the art. For example, U.S. Pat. No. 5,092,587 to Ulner, et al. discloses a series of metal tracks attached to a wall with bolts or the like, with a variety of holds adapted for attachment to the tracks at any location on the track. U.S. Pat. No. 5,254,058 to Savigny discloses a modular rough surface for attachment to a wall to provide a climbing surface wherein the rough surface provides the holds that the climber grasps during a climb.

Conventionally, many climbing walls use a grid of t-nuts mounted into a plywood or fiberglass wall surface as a means of bolting the climbing holds onto the wall. Some walls have permanent features sculpted onto the surface but use a t-nut grid to attach additional climbing holds. The holds may be relatively simple steps or bars, such as illustrated in the '587 patent to Ulner, or molded from plastic, fiberglass, or the like to resemble features that would be found on a natural rock face. In the climbing wall of Savigny, molded feature portions or modules are attached to the wall to form a unified climbing feature that substantially covers the wall. Such larger climbing features covering a portion of the climbing wall are desirable as well.

Climbing holds are designed for climbing, training, and exercising on a wall, on an artificial climbing surface, or on an individual mechanical device. Climbing holds are grabbed and stepped by a climber in order to ascend up and down the wall. It is important for the holds to be rigidly secured to the climbing wall in order to prevent the hold from rotational or translational movement under the weight of the climber.

Known removable holds are fixed to their support by means of a mechanical bolt. Such a bolt fixing system enables the climbing hold to be installed, removed, rotated, moved, or changed only with the use of a box or allen wrench or both. Such a bolt fixing system requires considerable time and effort of a person capable of handling these tools, and the time and effort is multiplied by the number of climbing holds to be installed, removed, rotated, moved, or changed on or from the climbing wall.

Typically, artificial climbing walls are designed to enable the climbing hold to be securely fastened to the wall by the presence of the mechanical bolt, which is passed partially through an aperture extending through the middle area of the climbing hold and then threaded into some type of receiving nut, t-nut, or other fastener. The nut, t-nut, or other fastener may be permanently secured to the wall, or the nut or fastener may be threaded onto the mechanical bolt from behind the wall.

The holds are generally manufactured from molded resin material, and the presence of a large aperture for passage of the bolt generally in the middle area does however cause a weakening of the mechanical strength of the climbing hold. When the bolt is tightened too tightly, or from forces caused during the climber's normal climbing exercise, this type of hold can break. When the bolt is tightened too loosely, or from forces caused during the climber's normal climbing exercise, this type of hold will spin or rotate right or left.

U.S. Pat. No. 6,074,327 to Franklin describes a climbing hold, which is capable of being securely bolted to a climbing wall without fracturing. A reinforcing sleeve is therefore secured within the aperture of the hold body, so as to support a portion of the hold body. The sleeve includes a tubular portion extending partially through the aperture, and radially extending end faces to prevent translation of the hold body when bolted to the climbing wall.

Safety is always a concern with any sport, and the ability to remove the lower climbing holds from a climbing wall when not in use would help to prevent unauthorized or unsupervised climbing. Nevertheless, the climbing holds are generally left on the climbing wall when the wall is not in use because of the time and expense necessary to remove them. Some facilities remove the lower climbing holds or place a tarp over the climbing holds in order to eliminate unsupervised climbing. There would be a large time and expense benefit, not to mention safety benefit, for the removal of these climbing holds in a relatively quick and easy manner.

There is a need for a climbing hold that overcomes the problems associated with known climbing holds by providing a climbing hold that can be removably attached, rotated, and detached quickly and easily.

SUMMARY OF THE INVENTION

The invention provides systems and methods for a selectively rotatable climbing hold for use on a climbing wall with a quick connect fastener system. The invention comprises a first component and a second component to allow for quick connection of the climbing hold to a climbing wall. The climbing hold is sized and configured to be mounted to the many already existing climbing walls without incurring major and costly changes, and can also be easily incorporated into the design of new climbing walls.

One aspect of the invention comprises a climbing hold for releasable securement to a climbing wall. The climbing hold comprises a first component and a second component. The first component or the second component includes a shaft, and the other one of the first component or the second component includes a bore, and the shaft is positioned within the bore to releasably secure the climbing hold to the climbing wall. The shaft may further include a portion having a polygon shape or a spline, the portion having the polygon shape or spline is sized and configured to be positioned within a mating shape of the bore.

In addition, the first component or the second component may include a projecting cleat to engage the climbing wall to reduce rotation of the climbing hold. The first component or the second component may also include a detent and the other one of the first component or the second component may include an indent, the detent being releasably receivable by the indent to releasably secure the climbing hold to the climbing wall.

Another aspect of the invention comprises a climbing hold for releasable securement to a climbing wall. The climbing hold comprises a female component for securement to the climbing wall, the female component including a bore, a male component, the male component including a climbing hold body and a lock pin having a shaft extending from the climbing hold body, and wherein the shaft of the male component is inserted into the female component to releasably secure the male component to the female component and the climbing wall. The shaft of the lock pin may further include a portion having a polygon shape or a spline, the portion having the polygon shape or spline being positioned within a mating shape of the bore of the female component. An activating tool may be required to allow the male component to be releasably secured and/or released to or from the female component.

Yet another aspect of the invention provides a climbing hold body for quick connect attachment to a climbing wall. The climbing hold body comprises a molded climbing hold body having an exposed surface and a climbing wall facing surface, a shaft having an exposed surface, the shaft extending outward from the climbing wall facing surface of the molded climbing hold body, and the shaft has a detent or an indent.

Yet an additional aspect of the invention provides in combination, a climbing hold, a climbing wall, and means for releasably securing the climbing hold to the climbing wall. The releasably securing means comprises first and second latching components, the first latching component comprises a bore containing an indented surface area and the second latching component comprises a shaft insertable in the bore of the first latching component and contains a latch detent engageable with the indented surface area, for retention of the shaft within the bore. Biasing means are included and are arranged to bias the detent into latching engagement with the indented surface area. Means for releasably disengaging the detent from the biased latching engagement with the indented surface area are also included. The detent may comprise a circumferential groove and the indent may comprise a ball sized and configured to fit within the circumferential groove.

Yet another aspect of the invention provides a method of releasably securing a climbing hold to a climbing surface, the climbing hold including a first component and a second component. The method comprises securing a first component to the climbing surface, positioning a second component in a mating relationship to the first component, the second component including a climbing hold body, and pushing the second component onto or into the first component for releasably securing the climbing hold to the climbing surface. The method may further include pushing an activation tool into a front surface of the climbing hold body to releasably secure the climbing hold to the climbing surface.

Yet another aspect of the invention provides a climbing hold using a male component and a female component. The male component is threaded on one end and includes a polygon shaped shaft (e.g., triangle, quadrilateral, hexagon, octagon), or spline shaft on the other end. The threaded-end is threaded into an existing nut, t-nut, or fastener located on or behind an existing mounting surface (i.e., climbing wall) and securely fastened. Once attached to the climbing wall, the shaft of the male component protrudes outwardly from the climbing wall in such a manner to accept the female component.

The female component comprises a climbing hold body having a mechanical device secured within a recess of the climbing hold body, the mechanical device being similar to the device as described in U.S. Pat. No. 4,692,073 to Martindell, which is hereby incorporated by reference in its entirety. By eliminating the large aperture extending completely through the center of the climbing hold body, the mechanical strength of the climbing hold is increased. In addition, the mechanical device eliminates the potential for climbing hold breakage resulting from over-tightening of the nut and bolt fixation systems.

The mechanical device includes a bore having a shape to receive the polygon shaped or spline shaft. The female component receives the male component and quickly and easily locks the male component within the female component. An activating tool may be used to allow the male component to be locked within the female component. The mechanical device, such as illustrated in the '073 patent, is firmly secured within the recess of the climbing hold body and will not spin, rotate, or pull away from the climbing hold body. The female component is considered to be one complete unit, whereby the climbing hold body cannot be removed from the mechanical device without damaging or breaking the female component. The female component will receive the polygon (e.g., hexagon) shaped or spline shaft of the male component. The hexagon shape or spline shaft will not allow the female component to freely spin or rotate around the male component, but it does allow selective positioning of the climbing hold. Each surface of the polygon or spline shaft provides a distinct climbing hold orientation.

The threaded end of the male component may include commonly used right hand threads. Thereby, right hand forces will tighten the male component to the climbing wall more securely and left hand forces will loosen it. If the male component is not tightened to the wall properly the male component along with the female component may spin loose to the left. In order to alleviate this possible loosening effect, a washer with protruding cleats may be placed between the climbing wall and the back surface of the male component. When the male component is tightened, the washer cleats will be embedded into the climbing wall front surface and the diagonal lock grooves of the male component will be embedded into the washer face in order to prevent left handed rotation. In addition, to further prevent the possibility of spin or rotation, a lock nut can be placed on the threaded ended of the male component behind the climbing wall and securely tightened.

The female climbing hold component can be released from the male component using an activating tool, which may be inserted into one or more small passages located on the front surface of the climbing hold and pressed against the release mechanism of the mechanical device. The female component can then be removed, rotated, moved, or changed quickly and easily with a simple push and pull motion.

The female climbing hold component may utilize a mechanical device similar to the device described in U.S. Pat. No. 4,692,073, which may be modified in order to be securely molded into the recess of the climbing hold body. The modifications may include a barrel shaped encasement formed around the outer cylindrical spindle so that resin will not seep into the spring, ball, and sleeve areas during the molding process. The modifications may also include reshaping the spindle and ears so that the climbing hold body cannot be separated from the mechanical device. Generally, climbing holds have a body made of molded resin, or cast material, such as synthetic plastic, polyurethane, metal ceramics, etc. The mechanical device can be made of steel, aluminum or stainless steel, for example.

The mechanical device utilizes a ball retained in a groove of the male component to releasably secure, i.e., lock, the male component in place. The ball is trapped between a spring biased movable sleeve and the bottom surface of the female bore. In this configuration, the ball is free to move in and out radially with respect to the longitudinally axis of the female bore because of manufacturing tolerances and clearances. The ball is accordingly loose and free to move both axially and radially. Positive holding of the male component against an extraction force is not accomplished until sufficient axial movement of the sleeve has taken place to wedge the ball between the back radius of the male component and the surface of the sleeve bore.

Examples of other mechanical devices similar in principal to the mechanical device discussed above include, U.S. Pat. No. 1,602,708 to Russell, U.S. Pat. No. 2,618,940 to Wyzenbeek, and U.S. Pat. No. 4,184,692 to Benson, et al. A feature common to these devices is a detenting ball which is entrapped between a sleeve and a recess. However, the ball is loose and is without a constant bias. The '692 and '708 patents utilize a plurality of balls detenting into a dimple in a cylindrical tool shank. The dimples and trapped balls provide resistance to both rotational and lateral movement of the tool relative to the spindle of the chuck, but only after tolerance and clearance spacing is taken up. The '940 patent likewise utilizes a plurality of balls trapped by a sleeve in a groove. A spline is utilized for rotational locking.

The mechanical device of the present invention uses a combination of normal and tangential forces to hold the male component in place within the female component. The normal tangential forces, as applied by the mechanical device of the present invention, securely lock the female component to the male component without allowing longitudinally or axial movement of the male or female components. And, once the climbing hold is properly fastened to the climbing wall, the climbing hold will not spin, rotate, or pull away from the climbing wall.

An additional aspect of the invention comprises a climbing hold including a male component and a female component, but the roles of the male and female components are reversed. The male component comprises a climbing hold body and a positive lock pin, with the positive lock pin being partially secured within a recess of the climbing hold body. The positive lock pin comprises a polygon shaped (e.g., triangle, quadrilateral, hexagon, octagon) or spline shaft that protrudes outwardly from the climbing hold body. The female component comprises an externally threaded bore, which is securely fastened to the climbing wall. The threaded bore includes protruding cleats, which will embed themselves into the wall when tightened in order to prevent rotation of the female component. Alternatively, the female component may be permanently molded directly into the wall. Again, the female component receives the male component and quickly and easily locks the male component in place using an activating tool.

In use, the female component is inserted into the climbing wall and securely fastened by a threaded nut and washer on the back side of the climbing wall. Rotational forces of the female bore are eliminated by the protruding cleats, which are embedded into the climbing wall front surface when the threaded nut is securely fastened. The male component includes a positive lock pin partially molded inside the recess of the climbing hold body. The portion of the positive lock pin that is not molded inside the recess of the climbing hold may be a polygon or spline shaft, which is received by the female bore. Within the positive lock pin is a plunger, which activates outwardly extending steel balls to seat and lock the hexagonal or spline shaft inside the female bore. The hexagonal or spline shape of the shaft and the matching shape of the receiving female bore prevent any rotation of the climbing hold. The hexagonal or spline shaft is of sufficient size and diameter in order to hold the weight of a climber while ascending or descending the climbing wall. This is known as shear strength, which is the primary force place on a climbing hold.

The male component can be released from the female bore using an activating tool, which may be inserted into one or more small passages on the front surface of the climbing hold body and pressed against the release button of the positive lock pin. The male climbing hold component can then be removed, rotated, moved, or changed quickly and easily with a simple push and pull motion.

The positive lock pin may be modified in order to be securely molded into the climbing hold body. The modifications may include a barrel shaped encasement being formed around the top end or button so that resin will not seep into the tubular or compression spring areas of the pin during the manufacturing process. The modifications may also include the addition of a cylindrical ring and ears, or other retaining features, to the top end so that the climbing hold body cannot be separated from or spin or rotate freely around the positive lock pin. Generally, climbing holds have a body made of molded resin, or cast material, such as synthetic plastic, polyurethane, metal ceramics, etc. The positive lock pin can be made of steel, aluminum or stainless steel, for example.

The positive lock pin utilizes a ball retained in a groove of the shaft portion of the pin. The ball is trapped between a spring biased movable plunger and the inside surface of the externally threaded female bore. In this configuration, the ball is free to move in and out radially with respect to the longitudinally axis of the hexagonal surface of the pin because of manufacturing tolerances and clearances. The ball is accordingly loose and free to move both axially and radially. Positive holding of the positive lock pin against an extraction force is not accomplished until sufficient axial movement of the plunger and compression spring has taken place to wedge the ball between the outside radius of the plunger and the inside surface of the female bore.

The positive lock pin of the present invention uses a combination of normal and tangential forces to hold the male component in place within the female bore. The normal tangential forces, as applied by the positive lock pin of the present invention, securely lock the male component to the female component without allowing longitudinally or axial movement of the male or female components.

Additional features of the present invention may include: 1) rubber or other flexible welting around the backside edge of the climbing hold in order keep pressure on the climbing hold and to fill any gaps between the wall and climbing hold aperture because not all climbing walls consist of a flat surface, 2) rubber or plastic plugs for the small passages on the front surface of the climbing hold in order to keep caulk or other debris from entering the mechanical device or positive lock pin, 3) an integrally molded diaphragm between the small passages on the front surface of the climbing hold and the mechanical device or positive lock pin in order to keep caulk or other debris from entering the mechanical device or positive lock pin.

BRIEF DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where;

FIG. 2 is a perspective view of a mechanical device molded within the climbing hold shown in FIG. 1, and also showing a male component prior to securing to a climbing wall.

FIG. 3 is a perspective view of a barrel shaped encasement that may be used to partially enclose the mechanical device molded within the climbing hold of the present invention.

FIG. 4 is a perspective view of an alternate embodiment of the male component shown in FIG. 2, the alternative embodiment having a spline shaft portion.

FIG. 5 is a side view in partial section taken generally along line 5-5 of FIG. 1, showing the mechanical device having the male component disposed within the bore and releasably locked in place.

FIG. 5A is a view in partial section of an alternate embodiment of a portion of the spindle illustrated in FIG. 5

FIG. 11 is a perspective view of the mechanical pin molded within the climbing hold shown in FIG. 10, and also showing the female bore component prior to securing to a climbing wall.

FIG. 12 is a perspective view of an alternate embodiment of the mechanical pin shown in FIG. 11, the alternative embodiment having a spline shaft portion.

FIG. 13 is a side view in partial section of the climbing hold of FIG. 10, showing detail of the mechanical pin.

DESCRIPTION OF THE PREFERRED EMBODIMENTS

Although the disclosure hereof is detailed and exact to enable those skilled in the art to practice the invention, the physical embodiments herein disclosed merely exemplify the invention which may be embodied in other specific structures. While the preferred embodiments have been described, the details may be changed without departing from the invention, which is defined by the claims.

Referring now to the Figures, an artificial climbing hold is illustrated which can be easily, quickly, and removably connected to a climbing structure.

One embodiment described herein comprises a first component (or first latching component) and a second component (or second latching component). The first component or the second component includes a climbing hold, and the other one of the first component or the second component includes a male component, the male component for attachment or securement to a climbing structure. The climbing hold has a quick connect mechanical device, which includes a spring biased sleeve having an inclined cam surface disposed against a ball or detent, and the ball in turn applies normal and tangential forces against a groove or indent in the male component to hold the male component in a bore. The sleeve is urged into contact with the ball by a compression spring disposed between a spindle and the sleeve. A ring secured to the spindle limits the movement of the sleeve in one direction, and the compression spring and the spindle limit the movement of the sleeve in the opposite direction. Through the cam surface, normal and tangential forces are applied by the ball against the groove in the male component to hold the male component firmly in the climbing hold bore to secure the climbing hold to the climbing structure. The holding action accomplishes a locking of the male component in place without allowing or permitting any longitudinal or axial movement. The holding action may be released by inserting an activating tool into the climbing hold which in-turn presses on the sleeve in a direction to offset the force of the spring and allowing the ball to return to a position which allows the male component to be removed from the bore of the climbing hold.

Figure 1:
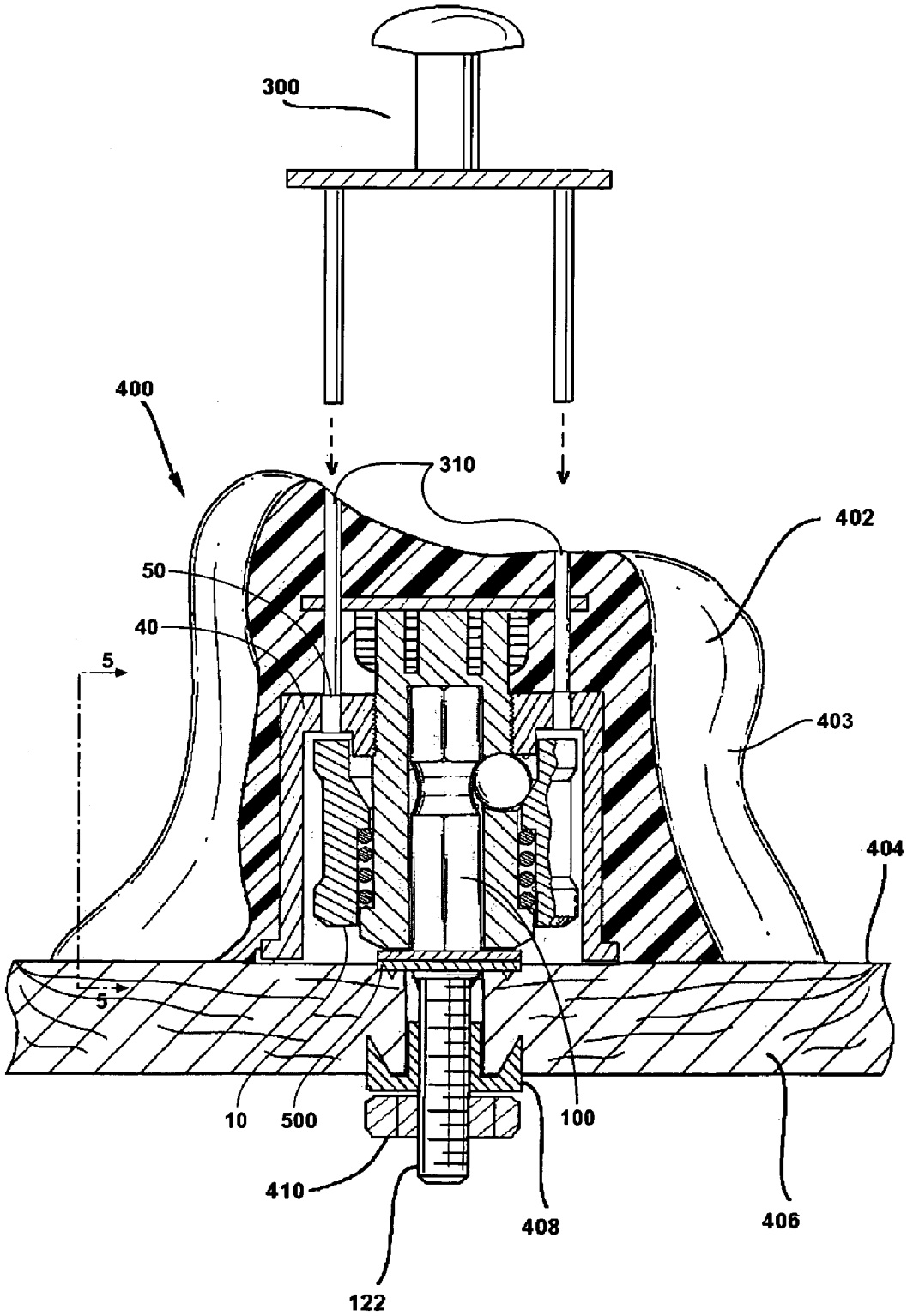
FIG. 1 is a side view in partial section of one embodiment of the present invention showing a climbing hold removably connected to a climbing wall and an activation tool used to connect and release the climbing hold from the wall.
Figure 1A:
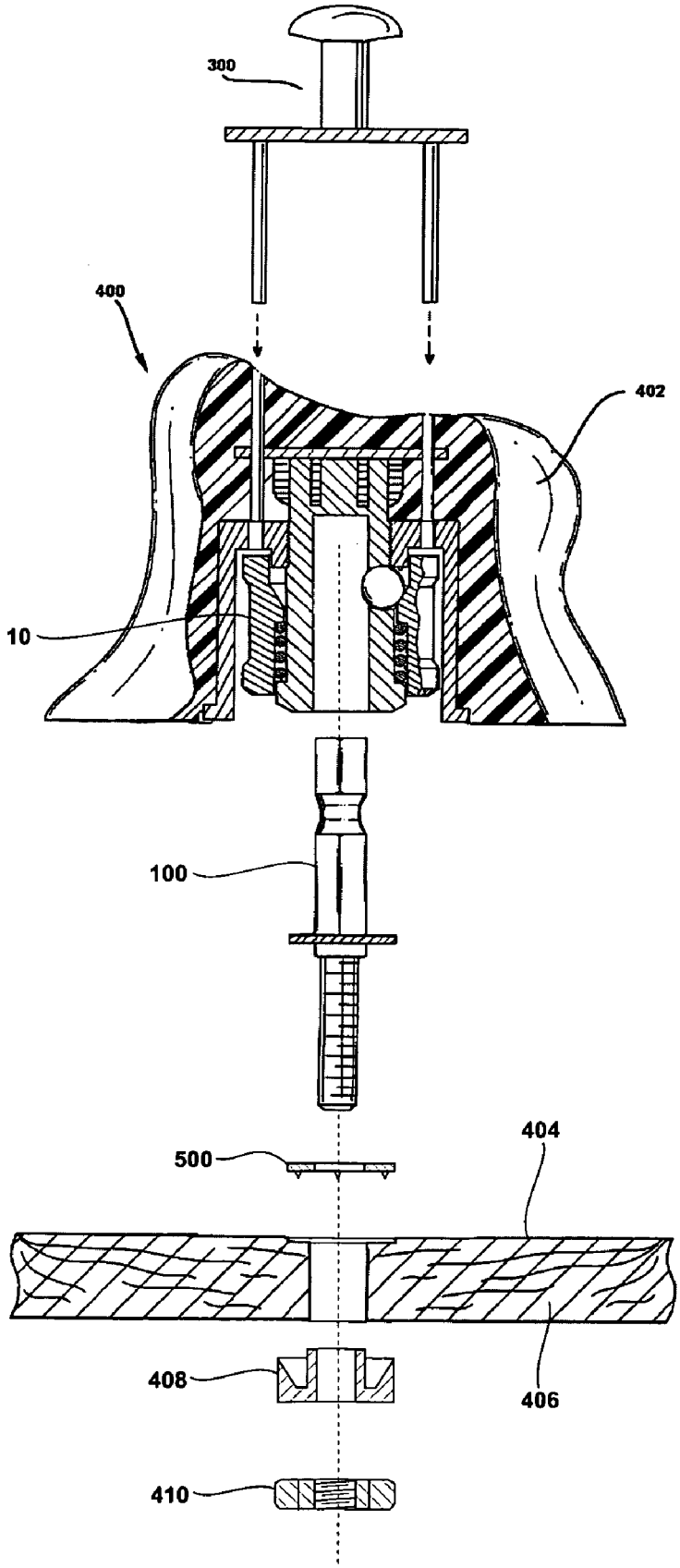
FIG. 1A is an exploded view of the climbing hold shown in FIG. 1.

FIGS. 1 and 1A show an embodiment of a climbing hold 400 having the features of the present invention as described above, and includes the female component 402, male component 100, climbing wall 406, locking nut 410, t-nut 408, and activating tool 300. The female component 402 includes a climbing hold body 403 and a mechanical device 10. The climbing hold body 403 may be of any of a variety of amorphous design having a configuration in order to simulate a climbing formation, e.g., a natural rock formation. The climbing hold body 403 provides a surface to which a climber may either grab or stand upon in order to traverse the climbing wall. The climbing hold body 403 may be formed of a molded polyester resin, which allows the climbing hold body 403 to be formed in a wide variety of shapes and sizes in order to accommodate a particular design requirement. Generally, the climbing hold body 403 may be made of molded resin, or cast material, such as synthetic plastic, polyurethane, metal ceramics, etc.

The mechanical device 10 is securely molded into a cavity of the climbing hold body 403. A barrel shaped encasement 40 surrounds the mechanical device 10 so that resin will not seep into the inner workings (e.g., spring 80, ball 90, and sleeve areas 60) of the mechanical device 10 during the molding process. The mechanical device 10 may also include retentive means, such as a spindle 12 with ears 14 and a cylindrical ring 16 so that the climbing hold body 403 cannot be separated from the mechanical device 10 (see FIG. 2). The mechanical device 10 can be made of steel, aluminum or stainless steel, for example. The climbing hold 400 is secured to a climbing wall 406 by way of the female component 402 including the mechanical device 10 and the male component 100, which is threadably engaged with a t-nut 408 or other fastener embedded in the wall. Locking nut 410 is then threaded on to male component 100 for additional anti-spin characteristics. Climbing wall 406 is typically a man made structure formed of a variety of materials such as wood, fiberglass, acrylic, polycarbonate, etc.

FIG. 2 is a perspective view of the male component 100 and the mechanical device 10 molded within the climbing hold body 403. The mechanical device 10 is shown spaced apart from the male component 100, which is slidably insertable into the mechanical device 10. The mechanical device 10 includes a spindle 12. At the rear end of the spindle 12 are a plurality of radially outwardly extending ears 14. The ears 14 prevent the relative rotation of the spindle 12 from the climbing hold body 403, shown generally in phantom. Also, at the very rear end of the spindle 12 may be a cylindrical ring 16 in an outward circumference from the spindle 12. The cylindrical ring 16 prevents the lateral release of the mechanical device 10 from the climbing hold body 403.

The spindle 12 includes a front end 18, which is generally perpendicular to the longitudinal axis of the spindle 12. Extending rearwardly from the front end or front face 18 is an internal bore 20. The internal bore 20 is illustrated as being of a hexagonal configuration. The male component 100 includes a hexagonal shank 102 which is adapted to be slidably received into, or to extend into, the hexagonal bore 20.

FIG. 3 is a perspective view of the mechanical device 10 encased in the barrel shaped encasement 40, shown generally in phantom view. The barrel shaped encasement 40 prevents resins from entering the sleeve 60, spring 80, and ball 90 located on the mechanical device 10.

FIG. 4 is a perspective view of an alternative mechanical device 200, which is similar to the embodiment of FIG. 2 except for a plurality of longitudinally axially extending flutes 202 at the protruding end of the male component 100. The flutes 202 perform substantially the same function as the hexagonal configuration, namely preventing relative rotational movement between the mechanical device 10 and male component 100. An alternative description may also be known as a spline shaft.

As seen in FIG. 2, the hexagonally shaped internal bore 20 extends rearwardly from the front end 18 of the spindle 12. The longitudinal axis of the bore 20 is substantially aligned with the longitudinal axis of the spindle 12. The front end 18, which defines a front face, is substantially perpendicular to the longitudinal axis of both the spindle 12 and the bore 20.

As seen in FIG. 5, the bore 20 includes a rear end 22. The rear end 22 defines a rear face, which is substantially perpendicular to the longitudinal axis of the bore 20 and is substantially parallel to the front end or face 18 of the spindle 12.

Extending radially inwardly on the spindle 12 from a front cylindrical portion 24 is a shoulder 25. The cylindrical portion 24 and the shoulder 25 are disposed just rearwardly of the front end 18. Rearwardly of the shoulder 25 is a circular or cylindrical portion 26. The diameter of the cylindrical portion 26 is less than the diameter of the front cylindrical portion 24. Rearwardly of the cylindrical portion 26 is an external threaded portion 28.

At about the juncture of the threaded portion 28 and the circular or cylindrical surface 26 is a radially extending bore 30. The bore 30 communicates with the bore 20. The bore 30 extends through the cylindrical portion 26 of the spindle 12.

Figure 6A:
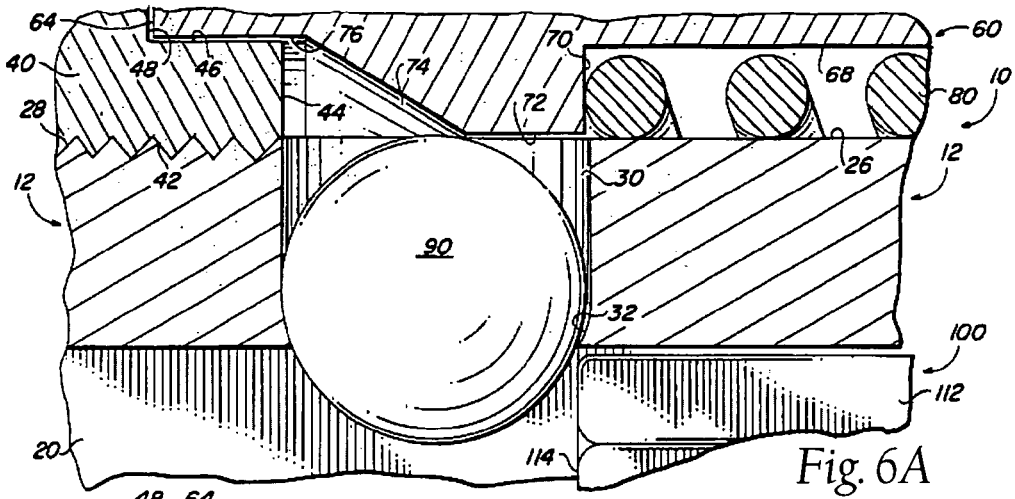
FIGS. 6A, 6B, 6C are enlarged views in partial section of a portion of the mechanical device shown in FIG. 1 illustrating the operation thereof.

At the juncture of the bores 20 and 30 there is a retainer lip 32. The retainer lip 32 extends inwardly to decrease the diameter of the radial bore 30 at the juncture of the bores 20 and 30. A ball 90 is disposed in the bore and is retained in the bore 30 by the retainer lip 32, or is prevented from falling out of the bore 30 by the lip 32. However, as shown in FIG. 6A, the lip 32 allows the ball 90 to extend a substantial distance into the bore 20.

The diameter of the ball 90 is slightly less than the diameter of the radial bore 30. There is accordingly very little side-to-side movement of the ball 90. However, the ball 90 moves axially in the bore 30, as will be discussed below. The axis of the bore 90 is substantially perpendicular to, and is centered on, one of the hexagonal flats or faces of the bore 20.

The barrel shaped encasement 40 is disposed about the spindle 12 on the threaded portion 28. The barrel shaped encasement 40 includes an internally threaded bore 42, which threadably engages the externally threaded portion 28 of the spindle 12.

At the inside of the barrel shaped encasement 40 is a front face 44. The front face 44 is substantially perpendicular to the longitudinal axis of the spindle 12. Extending rearwardly from the front face 44 is a relatively short cylindrical portion 46. At the rear of the cylindrical portion 46 is a radially outwardly extending ring 48. An inwardly cylindrically bore 55 extends rearwardly from the front face 59. A rear face 52 extends from the outer cylindrical portion 54 to the threaded bore 42. The rear face 52 is substantially parallel to the front face 44. Two cylindrical shaped access holes 50 penetrate the barrel shaped encasement 40 from the rear face 52 to radially outwardly extending ring 48, in order to insert the fingers 307 of the activating tool 300. The activating tool applies a forward pressure against the rear end face 64 of sleeve 60 to provide freedom of movement of ball 90.

After the barrel shaped encasement 40 is secured to the spindle 12, by the threaded engagement of the threaded portion 28 and threaded bore 42, the internal mechanisms are protected from resins during the molding process of the climbing hold body 403.

A moveable sleeve 60 is disposed about the spindle 12 and forwardly inside the barrel shaped encasement 40. The sleeve 60 includes a front end face 62. The face 62 is substantially perpendicular to the longitudinal axis of the spindle 12, as are the outer faces or front and rear surfaces as indicated herein. Parallel to the front end face 62 is a rear end face 64. The rear end face 64 is facing the shoulder 48 of the barrel shaped encasement 40.

Between the front end face 62 and the rear end face 64 is a cylindrical center section or portion 66. Relatively short cylindrical portions are disposed between the center cylindrical portion 66 and the faces 62 and 64. The relatively short cylindrical portions have diameters preferably slightly greater than the diameter of the center cylindrical portion 66.

Within the sleeve 60 is a front bore 68. The bore 68 extends rearwardly from the front face 62. The diameter of the bore 68 is slightly larger than that of the relatively short cylindrical portion 24 of the spindle 12, and the diameter of the bore 68 is accordingly substantially larger than that of the circular or cylindrical surface 26 of the spindle 12.

At the rear of the bore 68, remote from the front end face 62, is a radially inwardly extending shoulder 70. The shoulder 70 extends between the front bore 68 and a center bore 72. The diameter of the center bore 72 is slightly larger than that of the cylindrical portion 26 of spindle 12. The center bore 72 extends rearwardly from the shoulder 70 a relatively short distance.

Extending rearwardly from the center bore 72 is conically tapered bore 74. The conical bore 74 tapers outwardly and rearwardly from the center bore 72 to an enlarged diameter rear cylindrical bore 76. The diameter of the cylindrical bore 76 is slightly greater than that of the cylindrical portion 46 of the barrel shaped encasement 40. The cylindrical portion 46 of the barrel shaped encasement 40 is disposed partially within the bore 76.

A compression spring 80 extends between the shoulder 25 of the spindle 12 and the shoulder 70 of the sleeve 60. The spring 80 is disposed about the cylindrical portion 26 of the spindle 12, and within the front bore 68 of the sleeve 60. The spring 80 urges the sleeve 60 rearwardly against the shoulder 48 of the barrel shaped encasement 40.

The diameter of the ball 90, which ball is disposed within the radially extending bore 30 of the spindle 12, is substantially greater than the thickness of the cylindrical portion of the spindle 12 through which the bore extends. It follows that the diameter of the bore 30 is greater than the overall length of the bore. The ball 90 accordingly extends partially out of the bore 30 and into the bores 74 and 76 of the sleeve 60, partially into the hexagonal bore 20 of the spindle 12.

Under the urging of the compression spring 80, the conically tapered surface 74 of the sleeve 60 urges, by a spring 80, the ball 90 downwardly through the bore 30 of the sleeve 12 and into the hexagonally configured internal bore 20. Under the urging or bias of the spring 80, the ball 90 is cammed downwardly by the conical surface 74 until the ball is stopped in its radially inward or downward movement into the bore 20 by the retainer lip 32, and the male component 100, disposed within the bore 20.

In the embodiment of FIG. 5A, the shoulder 25 of the spindle 12 is substantially eliminated, and the cylindrical surface 26 accordingly extends forwardly to the front face 18. A groove 36 extends radially inwardly into the spindle 12 just rearwardly of the front face 18 and at the front part of cylindrical surface 26.

To retain the compression spring 80 on the cylindrical surface 26, a flat washer 84 is disposed about the cylindrical surface 26 of the spindle 20 and is retained there by a fastener, such as a retainer ring 86, which may be a "C" ring, a circlip, etc. The spring 80 accordingly extends between the washer 84 and the shoulder 70 of the sleeve 60.

The male component 100 includes a hexagonal shank 102 and a radially inwardly extending circumferential groove 104. The groove 104 is of a predetermined width and a predetermined depth. The groove 104 includes a pair of radius portion 106 and 108, and a bottom surface 110 between the radius portions 106 and 108. At the rear end of the male component 100 is a rear face 114. Between the groove 104 and the rear face 114 is a rear shank portion 112.

The distance between the rear face of end 114 of the male component shank 102 and the groove 104 is, like the dimensions of the groove 104, including the radii 106 and 108 and the surface 110. An important exception, however, is the distance between the location of the radial bore 30 and back surface 22 of the bore 20. The dimension between the radial bore 30 and the back surface 22 of the bore 20 has been reduced to assure that the ball 90 bears against the rear radius 108 of the groove 104. This is of fundamental importance in achieving the locking action described herein.

The correlation of the dimensions of both the male component 100 and the mechanical device 10 results in the ball 90 bearing against the rear radius 108 of the groove 104, or against its upper extremity at the juncture of the radius 108 and the exterior of the rear shank portion 112. The ball 90 accordingly extends into the groove 104 and against the rear radius 108 of the male component 100 to hold the male component 100 in the bore 20.

Figure 6B:
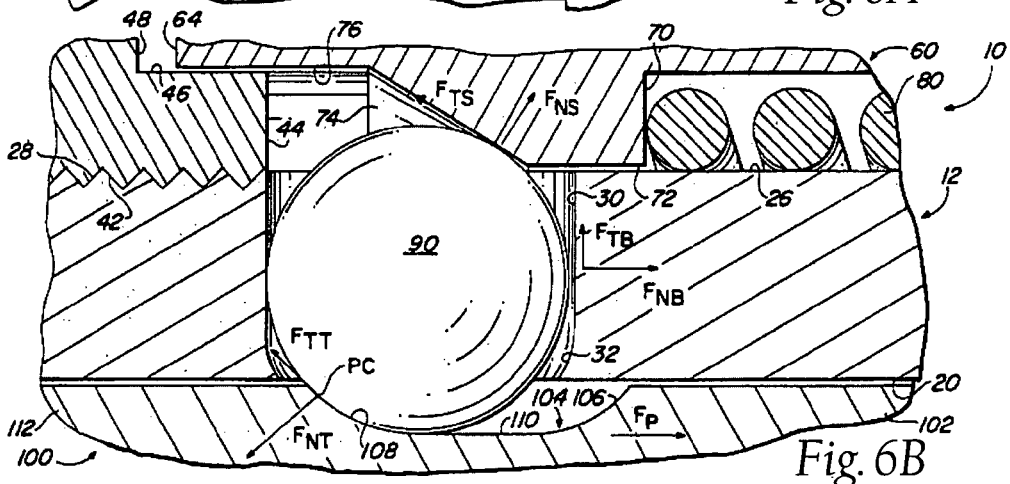
Figure 6C:
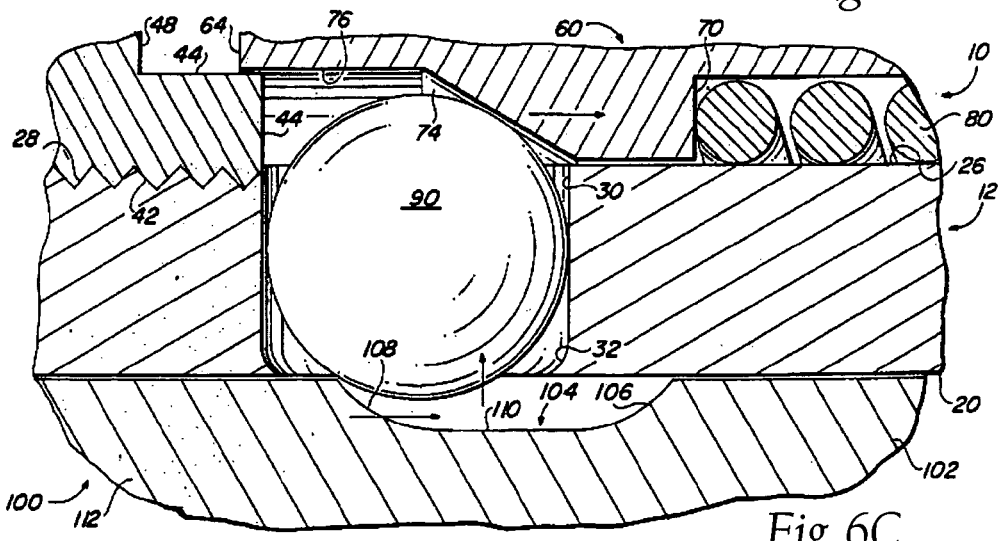

The insertion, removal, and locking of the male component 100 is illustrated in FIGS. 6A, 6B, and 6C.

With the male component 100 removed from the bore 20, the ball 90 extends downwardly into the bore 20 from the radial bore 30. The ball 90 extends downwardly a predetermined distance into the bore 20 according to the limitations of the retainer lip 32 at the juncture of the bore 30 and the bore 20. This is best shown in FIG. 6A. The ball 90 is cammed into that position in response to the urging of the spring 80 against the shoulder 70 of the sleeve 60.

In order to insert or to remove the male component 100 from the bore 20, the sleeve 60 is moved manually forwardly against the urging of the spring 80 so that the bore 72 is moved from the ball 90 to allow the ball 90 to move upwardly into the conical bore 74 and the cylindrical bore 76 of the sleeve 60. The ball 90 is moved substantially completely outwardly from the bore 20 and into the radial bore 30 and into the bores 74 and 76 by the camming of the end 114 of the male component shank 102 as the male component 100 is inserted into the bore 20. When the male component 100 is inserted fully into the bore 20, the rear end 114 of the male component shank 102 is disposed against the rear wall of face 22 of the bore 20, as shown best in FIG. 5.

When the sleeve 60 is released by the user of the mechanical device 10 after the male component 100 is placed in the bore 20, the compression spring 80 urges the sleeve 60 rearwardly. Under the rearward bias of the sleeve 60, the conical bore 74 of the sleeve 60 cams the ball 90 radially inwardly through the bore 30 and into the groove 104 against the radius 108 at the rear end of the groove 104 of the male component shank 102. The contact between the sleeve 60, the ball 90, and the male component 100 causes both frictional and normal forces to act on the male component 100 to hold the male component 100 securely in the spindle 12 of the mechanical device 10 and to prevent movement of the male component 100 within the bore 20.

It will be noted that the compression spring 80 need not be a very strong spring. A relatively light spring is sufficient to provide the necessary bias between the sleeve 60 and the spindle 12, and against the ball 90, to securely lock the male component 100 within the internal bore 20 of the mechanical device 10. The frictional and normal forces applied are sufficient to cause the male component 100 to be locked or held securely in the bore 20. In actuality, the greater the longitudinally outward pull on the male component, the great the lock up forces acting through the ball 90 between the spindle 12 and the sleeve 60 against the radius 108 of the male component shank 102 to secure the male component 100 within the bore 20.

As shown in FIG. 6B, when the male component shank 102 of the male component 100 is disposed fully within the bore 20, and the sleeve 60 is released so that its conical bore 74 is providing a rearward camming bias against the top or outer portion of the ball 90, the ball 90 contacts the rear surface of the bore 30 and the radius 108. Depending on the distance between the bore 30 and the end 22 of the bore 20, if the radius of the ball 90 is substantially the same as that of the radius 108, or if the radius of the ball 90 is slightly less than the radius 108, there in contact between the ball 90 and the radius 108 within the radius portion 108. Again, depending on the distance between the bore 30 and the end 22, if the radius of the ball 90 is greater than the radius portion 108, then contact between the ball 90 and the shank 102 will probably be at the juncture of the radius 108 and the outer periphery of the rear portion 112 of the male component shank 102. The radius of the ball 90 is preferably the same as the radius 108, or slightly less.

To remove the male component 100 from the bore 20, the sleeve 60 is moved forwardly, as indicated by the large arrow on the sleeve 60 in FIG. 6C, using an activating tool 300. The activating tool 300 is inserted into the two small holes 310 of the climbing hold body 403 and through the holes 50 of the barrel shaped encasement 40 and thereby applying a forward biasing pull on sleeve 60. A forward biasing pull is placed on the male component 100 at the same time the sleeve 60 is moved forwardly. This is shown in FIG. 6C by the large arrow on the male component 100. As the male component 100 is moved forwardly, the radius 108 of the groove 104 causes the ball 90 to be cammed upwardly within the radial bore 30 and upwardly within the conical bore 74 and the cylindrical bore 76. This is shown in FIG. 6C by the large arrow on the ball 90. When the ball 90 completely clears the bore 20, the male component 100 is free from the ball and is thus able to be removed from the bore 20. After the male component 100 is removed from the bore 20, the sleeve 60 may be released, and the ball 90 will be cammed downwardly into the radial bore 30 and partially into the hexagonal bore 20, as shown in FIG. 6A.

Returning again to FIG. 6B, arrows illustrating the frictional and normal forces are involved in the locking of the male component 100 in the mechanical device 10, are shown. It will be remembered that the drawing comprises a two-dimensional representation, while the actual elements involved are three-dimensional, and circular surfaces are involved. Accordingly, there is actually only single point contact between the ball 90, the radius 108 of the male component shank 102, and the bore 30 of the spindle 12 and the conical bore 74 of the sleeve 60. It will also be remembered that the bore 20 is hexagonal and that the male component shank 102, including its rear portion 112, is hexagonal. Thus, the hexagonal or non-circular configuration of both the bore 20 and the shank 102 prevents relative rotation between the spindle 12 and the male component 100.

In FIG. 6B, the point of contact between the ball 90 and the radius 108 of the groove 104 in the male component shank 102 of the male component 100 is identified by the letters PC. If forces are placed on the climbing hold 400, there will be a longitudinally outward pull on the male component 100 that is transferred from the male component 100 to the mechanical device 10 through the ball 90. The ball 90, in response to the outward pull, moves only a distance to the difference between its diameter and the diameter of the bore 30. And that difference, as stated above, is very small. The climbing hold 400 also moves that same distance. For all practical purposes, the ball 90 and the male component 100 do not move; rather they remain locked together in the spindle 12 of the mechanical device 10.

The pulling force exerted by the male component 100 is identified in FIG. 6B by the arrow identified as F.sub.P. The pulling force F.sub.P is, of course, opposed by an equal and opposite force acting through the ball 90 and against the mechanical device 10 through the point of contact PC. In addition to this opposing force acting in the longitudinal or axial direction, the reaction of the ball against mechanical device 10 will have a force component in the radial direction towards the axis of the tool. The reaction forces against the male component shank 102, the spindle bore 30, and conical sleeve bore 74 are shown by arrows in FIG. 6B. The arrows are for illustration purposes only, and are not scaled to each other.

For illustration purposes, as shown in FIG. 6B, the static analysis, based on the summation of orthogonal forces and moments about a center, gives the following relationship between the pull force F.sub.P and the various reaction forces:

F.sub.NT =
1.2 F.sub.P
F.sub.NS =
.40 F.sub.P
F.sub.NB =
.90 F.sub.P
F.sub.TT =
.15 F.sub.P
F.sub.TS =
.12 F.sub.P
F.sub.TB =
.27 F.sub.P In the above notation, "F" refers to the various forces. The first subscript "N" refers to normal forces and the first subscript "T" refers to tangential forces. For the second subscripts, "T" refers to the male component 100, "S" refers to the sleeve 60, and "B" refers to the spindle 12.

The reaction tangential force F.sub.TS on the conical surface 74 of the sleeve 60 tends to cause the sleeve 60 to be moved to the left in FIG. 6B. This force, as well as the other reaction forces, is observed to be proportional to the pull force on the male component 100, thus increasing with increases in F.sub.P the proportionality factors are a function of the dimensional and material parameters of the embodiment. This tangential reaction force F.sub.TS thus causes a "frictional backlash" resulting or causing a jamming action to hold the male component 100 in place.

It will be noted that in FIG. 6A there is shown a space between the ball and the right side of the radial bore 30. When a pulling force on applied on the male component 100 to the right as shown in FIGS. 6B and 6C, i.e., and outward pulling force, the ball 90 contacts the right side or front portion of the radial bore 30, as shown in FIG. 6C. When the male component 100 is inserted into the bore 20, and while the male component 100 is in use in the mechanical device 10, the ball 90 will be contacting the left or rear side of the bore 30, as shown in FIG. 6B. However, when an outward pull is exerted on the male component 100, as when a climber pulls on the climbing hold, then there will be a displacement of the ball 90 from the rear portion of the bore 30 to the front portion of the bore 30, which is a slight displacement to the right as shown in FIGS. 6A, 6B, and 6C. This displacement is shown in FIG. 6C, where the ball 90 is contacting the front or right side of the bore 30, and the ball 90 is accordingly spaced slightly from the left or rear portion of the bore 30. However, as stated earlier, the diameter of the bore 30 is only slightly larger than the diameter of the ball 90, and the displacement of the ball from one side of the bore to the other is virtually unnoticeable.

While the male component 100 referred to above has been discussed herein, and illustrated in the Figures, it is to be understood that the mechanical device of the present invention will work with any male component having a non-circular shank configuration and with a groove extending circumferentially about the shank such that the radius of the groove, or the width of the groove along with radius portions thereof, allows a ball, having about the same radius as that of the groove, to extend into the groove. The phrase "about the same radius" encompasses the three examples of ball radii as discussed above, namely substantially the same as, slightly larger than, and slightly less than, the radius of the groove. Similarly, the reference to the diameter of the ball 90 being "substantially the same as" that of the radial bore 30 refers to the fact that the diameter of the ball 90 is slightly less than the diameter of the bore 30, so that the ball 90 moves freely in the bore 30, but that the difference in the diameters is minimal so that there is no appreciable or noticeable longitudinal movement of the male component 100 in the bore 20 as a longitudinally axial pull is placed on the male component 100 and the ball 90 shifts from bearing against the rear wall of the bore 30 to bearing against the front wall of the bore 30.

Figure 7:
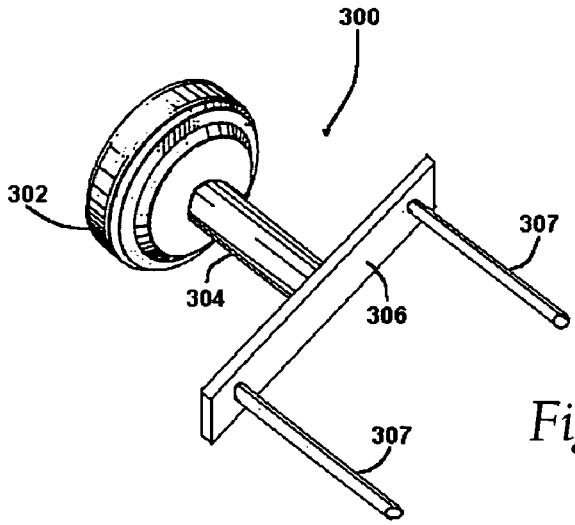
FIGS. 7, 7A, and 7B are perspective views of activating tools that may be used with the present invention.
Figure 7A:
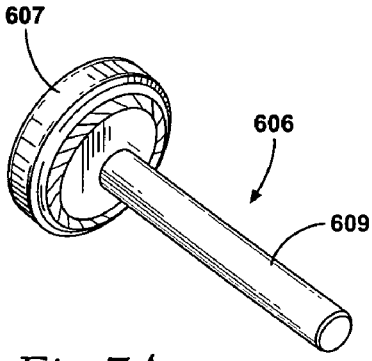
Figure 7B:
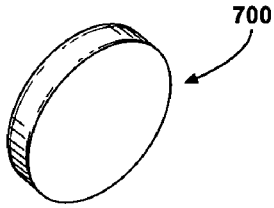

FIGS. 7, 7A, and 7B are perspective views of activating tools used in conjunction with the present invention. The activating tool 300 shown in FIG. 7 comprises two forks 307 coupled to a cross member 306, a stem 304, and a holding knob 302. The activating tool 300 is inserted into two relatively small holes 310 located on the outer surface of the climbing hold body 403 (see FIG. 1). Activating tool 606 shown in FIG. 7A comprises a holding knob 607 and a stem 609. The activating tool 606 is inserted into a small hole 611 located on the outer surface of the climbing hold body 603 (see FIG. 10). Activating tool 700 shown in FIG. 7B comprises a magnet. The magnet 700 may be used to activate the mechanical device 10 of climbing hold 400 or the positive lock pin 602 of climbing hold 600. The use of magnet 700 would eliminate the need for one or more small holes in the climbing hold body. When activating tool 700 is used, an additional magnet may also be included within the climbing hold body to work in coordination with the activating tool 700 to activate the mechanical device 10 or the positive lock pin 602.

Figure 8:
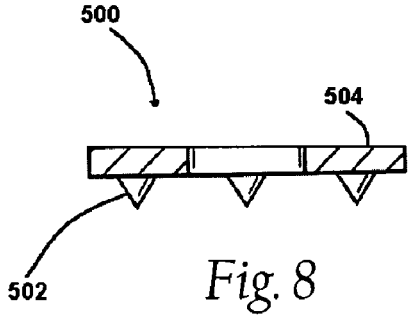
FIGS. 8 and 9 are side and top plan views of a washer with outwardly projecting cleats.
Figure 9:
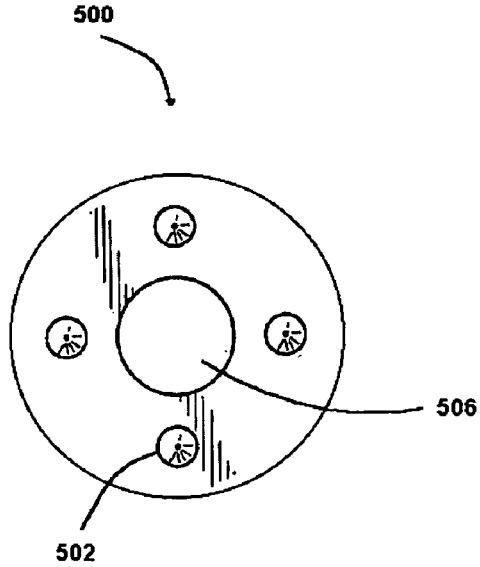

FIG. 8 and 9 is a side view and top view of the washer 500 with outwardly projecting cleats 502. The bore 506 of the washer 500 is slipped onto the threaded end of the male component 100 with the cleats 502 facing the wall front surface (see FIG. 5). When the male component 100 is tightened, the cleats 502 will be embedded into the wall front surface and the diagonal lock grooves 119 of the male component 100 will be embedded into the washer face 504 thereby providing a further means for resisting any left handed rotational forces of the climbing hold.

An additional embodiment 600 comprises a first component (or first latching component) and a second component (or second latching component). The first component or the second component includes a climbing hold, and the other one of the first component or the second component includes a female bore, the female bore sized and configured to be attached to a climbing structure. The climbing hold has a quick connect positive lock pin, which includes a spring biased plunger having an inclined cam surface disposed against a ball or detent, and the ball in turn applies normal and tangential forces against a circumferential groove or indent in the female bore to hold the male positive lock pin in the bore. The plunger is urged into contact with the ball by a compression spring disposed between a plunger and the tube. The plunger is activated and deactivated by pressure being applied to the button of the pin within the climbing hold aperture using an activating tool. The activating tool engages the plunger to move laterally wherein the balls are retracted substantially within the tube to unlock the positive lock pin from a mating bore or the balls are moved outwardly a sufficient distance to lock the positive lock pin within a mating bore. The holding action accomplishes a locking of the climbing hold, which includes the positive lock pin in place without allowing or permitting any longitudinal or axial movement.

Figure 10:
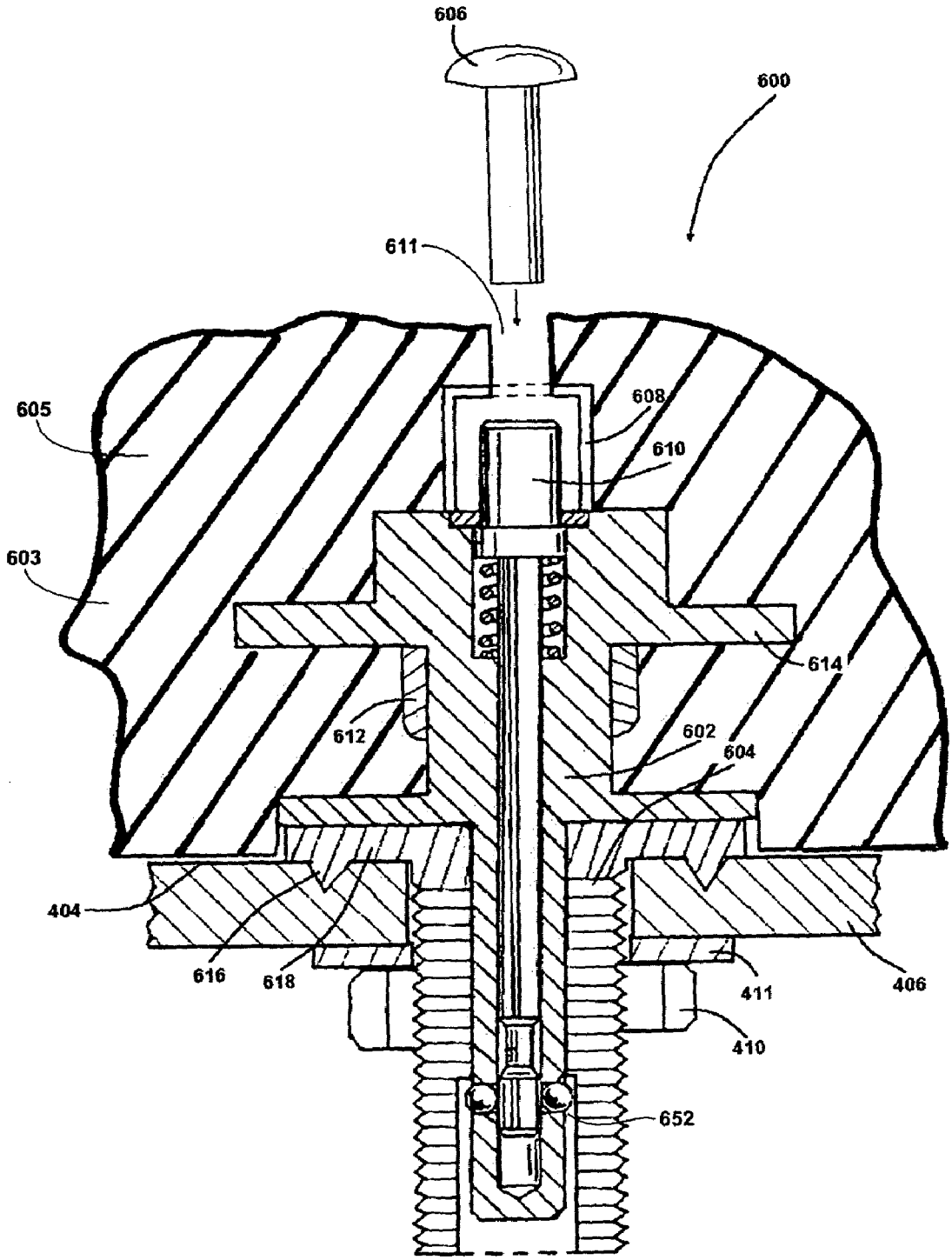
FIG. 10 is a side view in partial section of an additional embodiment of the present invention showing a climbing hold removably connected to a climbing wall and an activating tool used to connect and release the climbing hold from the wall.
Figure 10A:
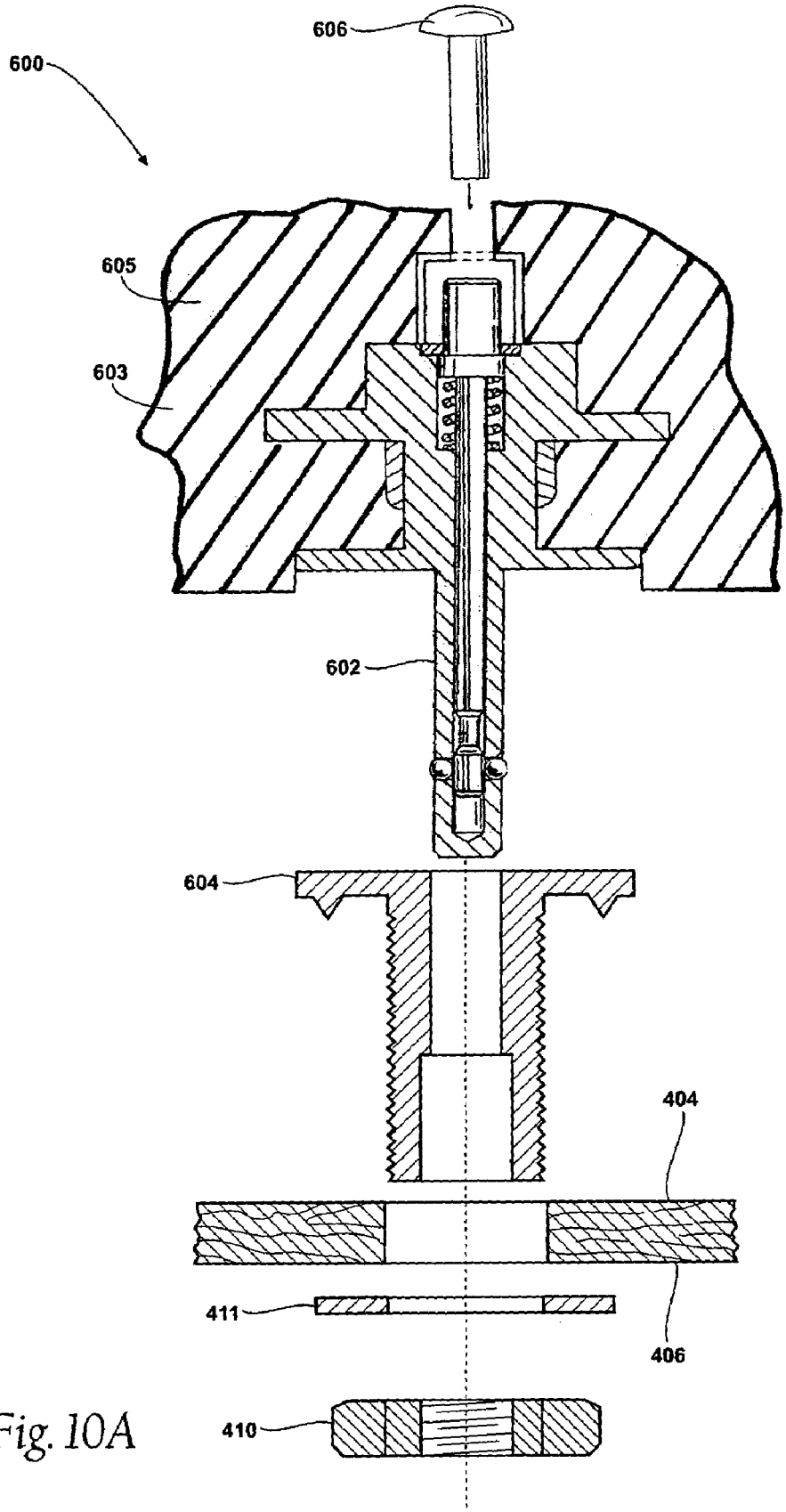
FIG. 10A is an exploded view of the climbing hold shown in FIG. 10.

FIGS. 10 and 10A show an additional embodiment 600 of the present invention including the male component 605, positive lock pin 602, female bore 604, climbing wall 406, lock nut 410, washer 411, and activating tool 606. The male component 605 includes the climbing hold body 603 and the positive lock pin 602. Similar to the climbing hold 400, the climbing hold body 603 may be of any of a variety of amorphous designs, and molded of various materials having a configuration in order to simulate a natural rock formation. The positive lock pin 602 is securely molded into the climbing hold body 603. A barrel shaped encasement 608 surrounds the button 610 of the positive lock pin 602 SO that resin will not seep into the shaft 622, plunger 636, ball 628, and spring 646 areas during the molding process. The small hole 611 may be later drilled after the molding process through the climbing hold body 603 and the barrel shaped encasement 608. The positive lock pin 602 may also include retentive means, such as a spindle portion with ears 612 and a cylindrical ring 614 SO that the climbing hold body 603 cannot be separated from the positive lock pin 602. The positive lock pin 602 can be made of steel, aluminum or stainless steel, for example.

The climbing hold 600 is secured to the climbing wall 406 by way of a male shaft component or positive lock pin 602 and a female bore 604, which is threadably secured to the climbing wall 406 with a nut fastener 410. When the nut fastener 410 is tightened, protruding cleats 616 on the cylindrical ring 618 of the female bore 604 will be embedded into the wall front surface 404 for additional anti-spin characteristics. Climbing wall 406 is typically a man made structure formed of a variety of materials such as wood, fiberglass, acrylic, polycarbonate, etc. The activating tool 606 is inserted into the climbing hold 600 followed by pressure being applied to the button 610 of the positive lock pin 602 in order to engage or disengage the locking climbing hold pin 602. The activating tool 606 (see FIG. 7A) may include a holding knob 607 and a stem 609.

FIG. 11 is a perspective view of the positive lock pin 602 and the female bore 604. The female bore 604 includes protruding cleats 616, which embed into the wall front surface when tightened, which eliminates rotation of the climbing hold. The positive lock pin 602 is shown spaced apart from the female bore 604, which is useable with the positive lock pin 602. The positive lock pin 602 includes a spindle 620. Retaining means may be included near the head of the spindle 620, such as a plurality of radially outwardly extending ears 612. The ears 612 prevent the relative rotation of the spindle 620 from within the climbing hold body 603. Also, at the head of the spindle 620 is a cylindrical ring 618 in an outward circumference from the spindle 620. The cylindrical ring 618 prevents the lateral release of the spindle 620 from the climbing hold body 603.

The spindle 620 includes a button 610, which is surrounded by a barrel shaped encasement 608. Extending rearwardly from the button 610 is a tubular shaft pin 622. The shaft pin 622 is illustrated as being of a hexagonal configuration, although any polygon or spline shape may be used. The female bore 604 includes a matching shaped receiver 605, e.g., hexagonal, which slidably receives the male tubular shaft pin 622 of the climbing hold aperture and locks or unlocks the climbing hold 600 in place.

FIG. 12 is a perspective view of an alternative positive lock pin 625, which is similar to the embodiment of FIG. 11, except for a plurality of longitudinally axially extending flutes 624 on the shaft 622 of the lock pin 625. The flutes or splines 624 perform substantially the same function as the hexagonal configuration, namely preventing relative rotational movement between the female component 604 and the lock pin 602.

As can be seen in FIG. 13, the tubular shaft pin 622 may include a plurality of ball apertures 626 through the shaft wall 630 adjacent to the tip 632. Each ball aperture 626 having at its outer side one or more restricting projections 634. The outer hexagonal surface 630 of the shaft pin 622 is hardened and smooth in order to slide easily into the receiver 605 of the female bore 604. Within each of the ball apertures 626 is a small hardened steel detent ball 628 of sufficient diameter to be restricted from escape by the restricting projections 634. The surface of the balls 628 projects through and sufficiently beyond the outer hexagonal surface of the tubular shaft wall 630 to serve as detent means for the positive lock pin 602. Within the tubular shaft pin 622, a reciprocal plunger 636 is slidingly received. In the side surface of the plunger 636 adjacent to its tip is machined an angular cam notch 638. It includes a relatively shallow portion 640 nearer the tip, of such depth as to cause the balls 628 to project radially beyond the hexagonal shaft wall surface 630; and a deeper portion 642 there adjacent, of a depth sufficient to permit the balls 628 to retract or recede inwardly as far as the hexagonal tubular shaft wall surface 630.

The length of the plunger 636, measured outwardly and opposite from its cam notch 638, is substantially greater than the length of the shaft pin 622, measured outwardly from the ball apertures 626, so that the plunger 636 extends well beyond the outer end of the shaft pin 622. Beyond the shaft pin 622 outer end but inward of the plunger button end 610, the plunger 636 has an angularly enlarged portion 644 faced on its inner side by an inward facing abutment 648, against which a compression spring 646 bears and presses it outwardly from the pin button end 610. On the outer side of the angular enlarged portion 644 is an outward facing angular shoulder 650, which serves as one of two mating surfaces for excluding foreign matter. The button 610 of the positive lock pin 602 in enclosed inside of the barrel shaped encasement 608 in order to prevent resins from entering the tubular or compression spring areas of the positive lock pin 602 during the manufacturing process. The small hole 611 may be later drilled after the molding process through the climbing hold body 603 and the barrel shaped encasement 608.

To engage the climbing hold positive lock pin 602 through the female bore 604 secured to a climbing wall, the plunger button 610 is depressed against the compression spring 646 permitting the detent balls 628 to retract or recede inwardly into the deeper portion of the cam notch 638. When pressure on the plunger button 610 is released, the compression spring 646 draws the plunger 636 outward so that the detent balls 628 extend outwardly to lock the tubular shaft pin 622 inside the groove 652 of the female bore 604. The hexagonal shape of the tubular shaft pin 622 restricts any rotational movement.

While the principals of the invention have been made clear in illustrative embodiments, there will be immediately obvious to those skilled in the art many modification or structure, arrangement, proportions, the elements, material, and components used in the practice of the invention, and otherwise, which are particularly adapted for specific environments and operative requirement without departing from those principles. The appended claims are intended to cover and embrace any and all such modifications within the limits only of the true spirit and scope of the invention.

I claim:

1. A climbing hold for releasable securement to a climbing wall, the climbing hold comprising:

a female component for securement to the climbing wall, the female component including a tubular bore portion having an inside diameter and external threads, a ring coupled to the tubular portion at or near one end of the tubular portion, the ring including at least one cleat to engage the climbing wall, and a circumferential groove about the inside diameter of the tubular portion, the groove being parallel to the ring and located at or near an end of the tubular portion opposite that of the ring, a male component, the male component including a climbing hold body and a lock pin having a movable plunger, the lock pin having a shaft extending from the climbing hold body, and wherein the shaft of the male component is inserted into the female component to releasably secure the male component to the female component and the climbing wall.

2. A climbing hold according to claim 1 the shaft of the lock pin further including a portion having a polygon shape or a spline, the portion having the polygon shape or spline being positioned within a mating shape of the bore of the female component.

3. A climbing hold according to claim 1 wherein an activating tool is required to allow the male component to be releasably secured within the female component.

4. A climbing hold according to claim 1 wherein an activating tool is required to release the male component from the female component.

5. A climbing hold according to claim 4 wherein the activating tool comprises a magnet, the magnet adapted to release the male component from the female component without contacting the male component or the female component.

6. A climbing hold according to claim 1 wherein the shaft of the male component allows selective rotation of the climbing hold when the climbing hold is being positioned and a fixed position when the climbing hold is releasably secured to the climbing wall.

7. A climbing hold according to claim 1 wherein the male component includes retentive means for eliminating separation of the climbing hold body from the shaft.

8. A climbing hold for releasable securement to a climbing wall, the climbing hold comprising:

a female component for securement to the climbing wall, the female component including a tubular bore portion having an inside diameter and external threads, a ring coupled to the tubular portion at or near one end of the tubular portion, the ring including at least one cleat to engage the climbing wall, and a circumferential groove about the inside diameter of the tubular portion, the groove being parallel to the ring and located at or near an end of the tubular portion opposite that of the ring, a male component, the male component including a climbing hold body and a lock pin having a movable plunger, the lock pin having a shaft extending from the climbing hold body, wherein the shaft of the male component is inserted into the female component to releasably secure the male component to the female component and the climbing wall, and wherein the lock pin of the male component includes a spring biased plunger having an inclined cam surface disposed against a ball, and the ball in turn applies normal and tangential forces against the circumferential groove in the female component to releasably secure the shaft of the lock pin in the bore of the female component.

9. A climbing hold according to claim 8 the shaft of the lock pin further including a portion having a polygon shape or a spline, the portion having the polygon shape or spline being positioned within a mating shape of the bore of the female component.

10. A climbing hold according to claim 8 wherein an activating tool is required to allow the male component to be releasably secured within the female component.

11. A climbing hold according to claim 8 wherein an activating tool is required to release the male component from the female component.

12. A climbing hold according to claim 11 wherein the activating tool comprises a magnet, the magnet adapted to release the male component from the female component without contacting the male component or the female component.

13. A climbing hold according to claim 8 wherein the shaft of the male component allows selective rotation of the climbing hold when the climbing hold is being positioned and a fixed position when the climbing hold is releasably secured to the climbing wall.

14. A climbing hold according to claim 8 wherein the male component includes retentive means for eliminating separation of the climbing hold body from the shaft.

15. A system comprising:

a climbing hold, a climbing wall, means for releasably securing the climbing hold to the climbing wall, the releasably securing means comprising:

first and second latching components, the first latching component comprising a bore defining a polygon shape or a spine, the bore containing an indented surface area, and the second latching component comprising a shaft defining a polygon shape or a spline, the shaft being insertable and non-rotatable within the mating shape of the bore of the first latching component and containing a latch detent engageable with the indented surface area, for retention of the shaft within the bore, biasing means arranged to bias the detent into latching engagement with the indented surface area, and means for releasably disengaging the detent from the biased latching engagement with the indented surface area, the releasably securing means adapted to secure the climbing hold to the climbing wall so that the climbing hold can not rotate in a clockwise or counter-clockwise fashion when secured to the climbing wall.

16. A climbing hold according to 15 wherein the detent comprises a circumferential groove and the indent comprises a ball sized and configured to fit within the circumferential groove.

* * * * *

UNITED STATES PATENT AND TRADEMARK OFFICE

CERTIFICATE OF CORRECTION

PATENT NO. : 7,594,874 B2
APPLICATION NO. : 11/402712
DATED : September 29, 2009
INVENTOR(S) : Richard K. Meissner It is certified that error appears in the above-identified patent and that said Letters Patent is hereby corrected as shown below:

Column 19, line 13, delete "spine" and substitute -- spline --

Signed and Sealed this

Twenty-fourth Day of November, 2009

David J. Kappos

David J. Kappos
*Director of the United States Patent and Trademark Office*